US006848362B2

(12) United States Patent
Petersen et al.

(10) Patent No.: US 6,848,362 B2
(45) Date of Patent: Feb. 1, 2005

(54) VARNISHING APPARATUS

(75) Inventors: Godber Petersen, Augsburg (DE); Rainer Stamme, Augsburg (DE)

(73) Assignee: MAN Roland Druckmachinen AG, Offenbach am Main (DE)

( * ) Notice: Subject to any disclaimer, the term of this patent is extended or adjusted under 35 U.S.C. 154(b) by 0 days.

(21) Appl. No.: 10/365,320

(22) Filed: Feb. 12, 2003

(65) Prior Publication Data

US 2003/0159602 A1 Aug. 28, 2003

(30) Foreign Application Priority Data

Feb. 26, 2002 (DE) ..... 102 08 270

(51) Int. Cl.[7] ..... B41F 13/02; B41F 5/04; B41F 23/08

(52) U.S. Cl. ..... 101/220; 101/247; 101/479; 101/480

(58) Field of Search ..... 101/220, 247, 101/479–480, 216–218, 182, 184, 185, 153, 477

(56) References Cited

U.S. PATENT DOCUMENTS

| | | | | |
|---|---|---|---|---|
| 4,664,949 A | | 5/1987 | Greiner et al. | |
| 4,706,601 A | | 11/1987 | Jahn | |
| 5,063,844 A | * | 11/1991 | Fausel | 101/247 |
| 5,178,678 A | | 1/1993 | Koehler et al. | |
| 5,802,975 A | | 9/1998 | Prem et al. | |
| 5,806,427 A | * | 9/1998 | Niemiro et al. | 101/247 |
| 5,868,071 A | * | 2/1999 | Niemiro et al. | 101/218 |
| 6,070,528 A | | 6/2000 | Fleischmann et al. | 101/170 |
| 6,085,650 A | * | 7/2000 | Petersen | 101/220 |
| 6,186,065 B1 | | 2/2001 | Kersch et al. | 101/216 |
| 6,311,619 B1 | | 11/2001 | Stamme et al. | 101/425 |
| 6,376,017 B1 | | 4/2002 | Kaule et al. | 427/271 |
| 6,397,743 B1 | * | 6/2002 | Dauer et al. | 101/220 |

FOREIGN PATENT DOCUMENTS

| | | | |
|---|---|---|---|
| DE | 3837941 | 5/1990 | B41C/1/00 |
| DE | 43 41 246 C1 | 2/1995 | |
| DE | 4401362 | 7/1995 | B41F/9/01 |
| DE | 19633514 | 11/1997 | B41M/5/26 |
| DE | 19746268 | 4/1999 | B41M/1/24 |
| DE | 19807505 | 8/1999 | B41F/23/08 |
| DE | 19962582 | 7/2000 | B41F/23/08 |
| DE | 19935173 | 2/2001 | B05C/1/08 |

* cited by examiner

*Primary Examiner*—Daniel J. Colilla
*Assistant Examiner*—Marissa Ferguson
(74) *Attorney, Agent, or Firm*—Cohen, Pontani, Lieberman & Pavane

(57) ABSTRACT

To provide a varnishing apparatus for indirect printing with the lowest possible structural outlay, a varnishing mechanism of the varnishing apparatus for varnishing webs includes a form cylinder and a transfer cylinder, the web running between the transfer cylinders. At least one of the form cylinders bears a gravure printing form such that the web may be varnished on one or both sides.

10 Claims, 3 Drawing Sheets

VARNISHING APPARATUS

BACKGROUND OF THE INVENTION

1. Field of the Invention

The invention relates to a varnishing apparatus having at least one varnishing mechanism with a form cylinder and a transfer cylinder.

2. Description of the Related Art

German DE 199 35 173 A1 discloses a varnishing apparatus for varnishing one side of a sheet. The varnishing apparatus includes an applicator cylinder for applying ink to a printing cylinder. A metering system comprising a gravure roll and chamber-type doctor is arranged on the applicator cylinder. A disadvantage of this device is that two varnishing apparatuses configured in this way are required for varnishing two sides of the sheet.

SUMMARY OF THE INVENTION

An object of the present invention to provide a varnishing apparatus for varnishing both sides of a sheet by indirect printing, which is designed with the lowest possible constructional outlay.

According to the present invention, the object is achieved by a varnishing apparatus for varnishing a web including first and second varnishing mechanisms, each including a form cylinder and a transfer cylinder. A web having two sides runs between the transfer cylinders. At least one of the form cylinders has a gravure printing form arranged thereon. The varnishing apparatus is arrangeable for varnishing one of the sides of the web when only one of said form cylinders includes a gravure printing form and for varnishing both of the sides of the web when each of the form cylinders includes a gravure printing form.

The mounting of the varnishing mechanism cylinders on the walls of the openings in the side walls of the varnishing apparatus allows the supporting forces for the cylinders of the varnishing mechanism to be introduced directly and at right angles into the side walls, in the longitudinal direction of the side walls. The support of the cylinders is therefore very rigid and exhibits little vibration, which is a precondition of a good print quality and the quality of the varnish application. It is possible for high forces to be applied. The apparatus is constructed using a simple design and, as a result, can be set up cost-effectively. For example, the guide elements may be implemented with commercially available rectilinear guides. The varnishing units are also distinguished by a compact and space-saving design.

Varnishing on one or both sides of the sheet may be carried out by the indirect gravure printing process, it being possible to bring about varnishing of the entire surface or partial varnishing. Varnishing both sides is advantageously done in a double printing mechanism, configured or reconfigured as a double varnishing mechanism. This possibility is not provided in flexographic printing, for example, since it is not possible for two relief printing forms to run against each other at the same time. Since the gravure printing form has a variable depth, different varnishes can be transferred in one printing form. Instead of varnishes, inks or special inks may also be transferred to the sheet in the varnishing apparatus.

The indirect gravure printing process of the present invention allows single-sided varnishing to be carried out with an impression cylinder and two-sided varnishing being carried out in a double printing mechanism. Thus, recto and verso varnishing can be carried out in one printing pass.

The indirect gravure printing process may be used in any printing line upstream —for example for paper finishing—or downstream of the printing mechanisms. The printing lines can be conventional or digital printing lines such as, for example, electrostatic printing systems.

The varnishing apparatus according to the present invention may be arranged in-line in a printing line, so that printing and varnishing are carried out in one operation. However, the varnishing apparatus according to the present invention may also be arranged off-line of a printing line, for example as a separate special machine, so that varnishing is carried out in a separate operation using the varnishing apparatus.

The varnishing apparatus of the present invention may optionally be used either to varnish or print in the gravure printing or offset printing process. The inventive varnishing apparatus may be changed over simply from one process to the other. In addition, both printing processes can be used at the same time. Furthermore, one printing process may be used for example for the recto printing and the other printing process for the verso printing. The printing-machine manufacturer can set up the machines for both processes identically from the same components, which permits cost-effective fabrication. In addition, the varnishing apparatuses may be designed with variable format, that is to say they can be re-equipped simply for other formats, that is to say other diameters of the varnishing mechanism cylinders or printing mechanism cylinders and cut lengths. Furthermore, the varnishing apparatus can be changed over quickly to different production variants. In addition, the varnishing apparatus may also be re-equipped as a printing mechanism in a printing machine or at least either for the recto printing or for the verso printing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
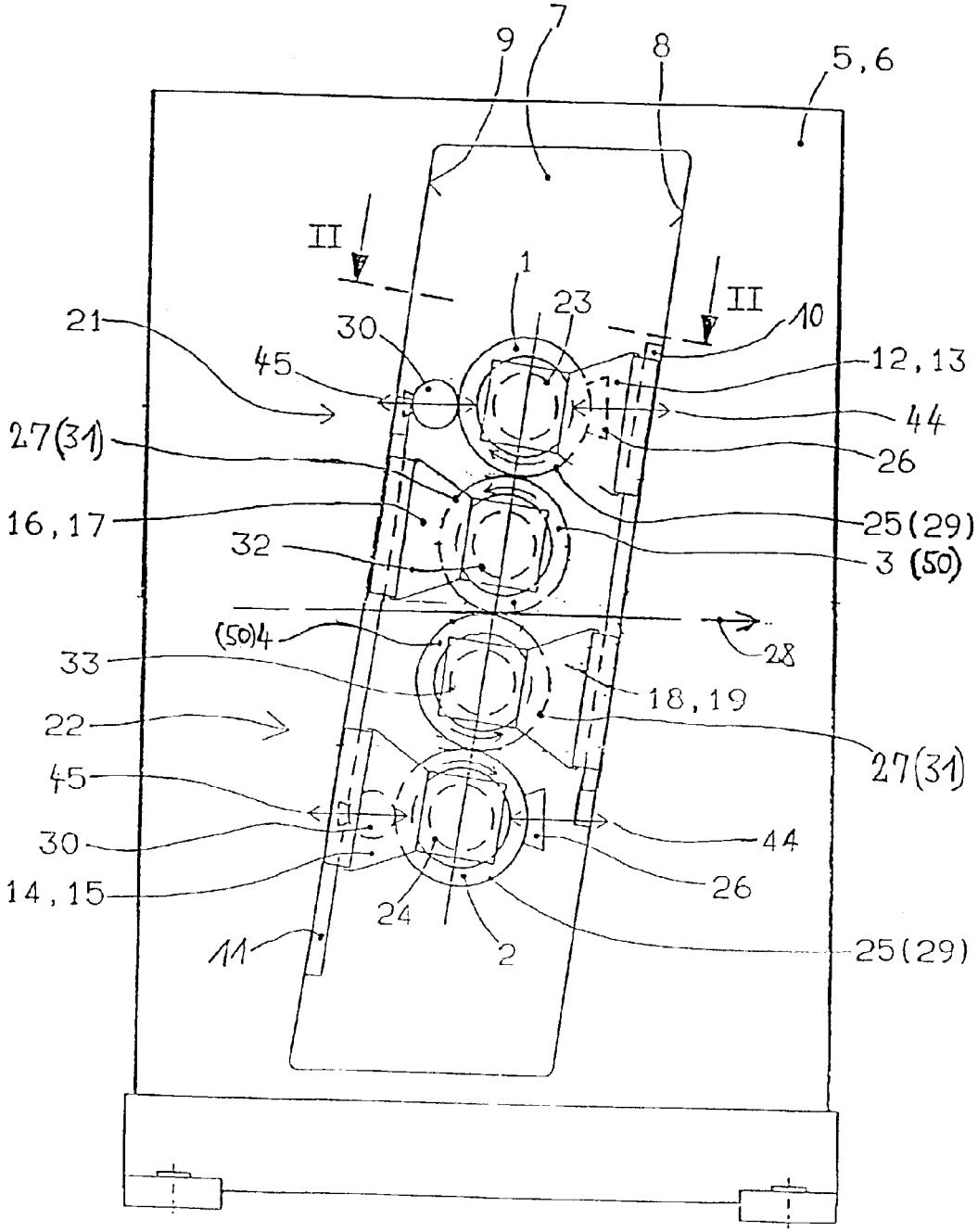
FIG. 1 is a schematic side view of a varnishing apparatus according to the present invention.
Figure 2:
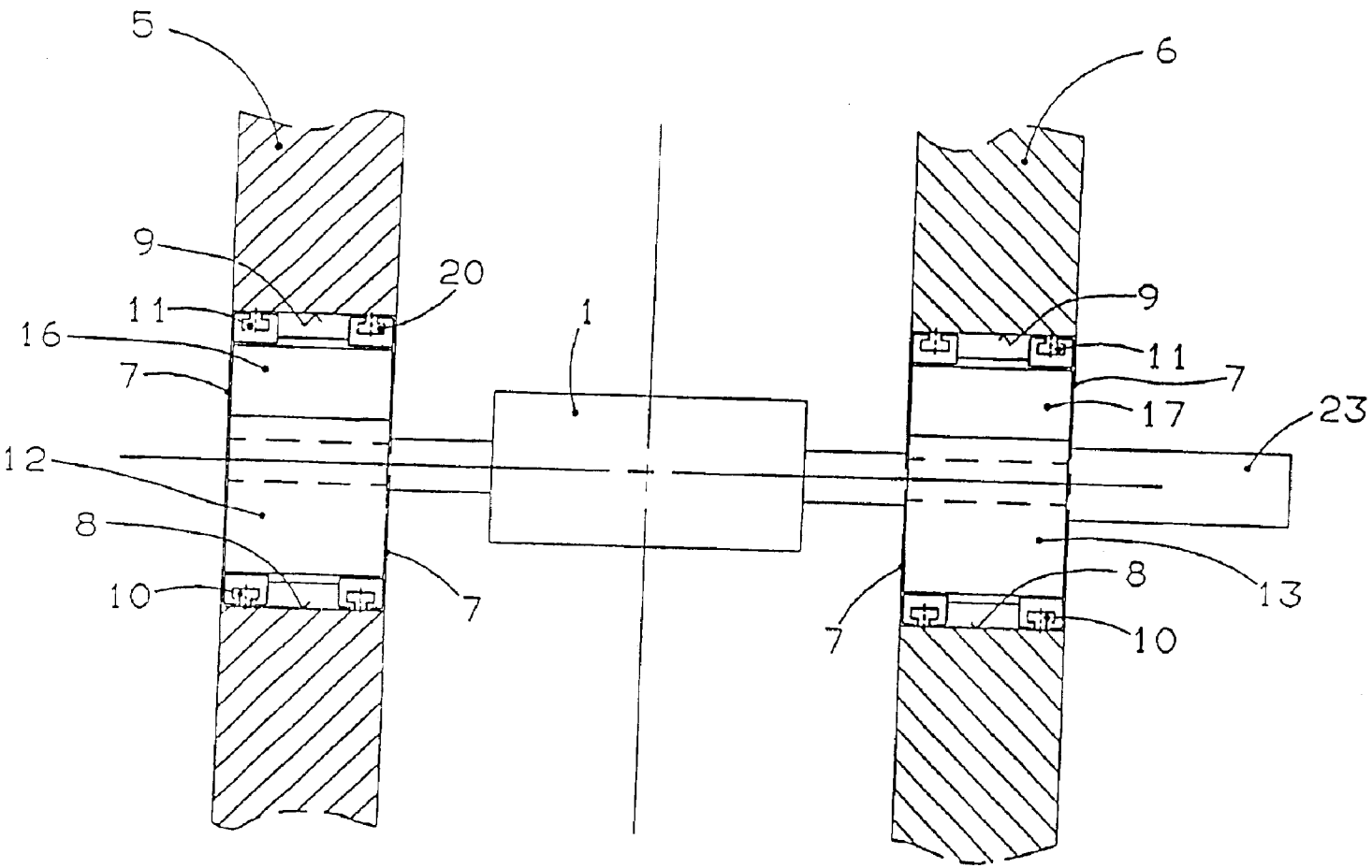
FIG. 2 is a sectional view of the varnishing apparatus of FIG. 1 along the line II—II.

FIGS. 1 and 2 show a varnishing apparatus according to the present invention for use in a web-fed rotary printing machine having two form cylinders 1, 2 and two transfer cylinders 3, 4. Each form cylinder 1, 2 and transfer cylinder 3, 4 includes two opposing ends respectively mounted in side walls 5, 6. Each side wall 5, 6 has an opening 7 therethrough which is bounded by opposing sides 8, 9. The openings 7 may, for example, also be designed as an open slot. Rectilinear guide elements 10, 11 are arranged along the sides 8, 9 of the opening 7.

Each end of the form cylinders 1, 2 includes a journal mounted in a respective slide 12 to 15. The transfer cylinders 3, 4 likewise include journals mounted respectively in slides 16 to 19. The slides 12 to 19 are mounted on the guide elements 10, 11 such that the slides 12 to 19 are movable on the guide elements 10, 11 (see FIG. 2). To create a form-fitting slide guide, the guide elements 10, 11 have a T-shaped cross section with a crossbar that engages in an appropriately designed undercut groove 20 on each slide 12 to 19. For the purpose of mobility, each slide 12 to 19 has a threaded nut which interacts with a threaded spindle which can be driven and is mounted in the respective side wall 5, 6. These elements are not illustrated in the present application but are described in U.S. Pat. No. 6,397,743, the entire contents of which are incorporated herein by reference.

The form cylinder 1 and the transfer cylinder 3 form a first varnishing mechanism 21. Likewise, the form cylinder 2 and the transfer cylinder 4 form a second varnishing mechanism 22. Both varnishing mechanisms 21, 22 are designed for indirect gravure printing. Each form cylinder 1, 2 is respectively driven by a drive motor 23, 24, which may comprise a position-controlled electric motor. Drive motors 32, 33 may also be provided for driving the transfer cylinders 3, 4. Alternatively, the transfer cylinders 3, 4 or the form cylinders 1, 2 may also be driven by friction.

Each form cylinder 1, 2 includes a sleeve-like gravure printing form 25 arranged thereon, against which a gravure inking unit 26 may be set. A sleeve 27, such as a rubber cylinder sleeve, is arranged on each transfer cylinder 3, 4. When the transfer cylinders 3 and 4 are set against the form cylinders 1, 2, the first and second varnishing mechanisms 21, 22 print on both sides of a web 28 running between the transfer cylinders 3, 4.

Alternatively, one of the transfer cylinders 3, 4 may be configured as an impression cylinder 50. In this configuration, the respective one of the form cylinders 1, 2, corresponding to the one of the transfer cylinder 3, 4 configured as an impression cylinder 50, may be dispensed with. The web 28 is thus printed on one side.

The sleeve-like gravure printing form 25 may, for example, be engraved directly. However, the printing form 25 may alternatively be coated with a substrate, such as epoxy resin or another thermosetting plastic, and then engraved. For the purpose of engraving, laser-beam or electron-beam engraving may be used. Furthermore, the surface of the gravure printing form 25 on which the printing image is arranged may also consist of equal cells arranged regularly, whose volume is reduced by an introduced substance in accordance with the subject to be printed. This can be accomplished by first introducing the substance into the cells in a quantity inversely proportional to the quantity of ink or varnish to be transferred. Suitable for this purpose are, for example, a melt spraying process or inputting by a thermal transfer film. These processes are described, for example, in the German patent application DE 38 37 941 C2. However, the cells may also initially be filled with the substance by a thermal transfer film with no image applied or a melt inking unit with doctor. The printed image is then written in by substance being removed in the quantity of the quantity of ink to be transferred. The latter may, for example, be accomplished by a laser. The gravure printing forms 25 may have an image set on them while lying flat or while they are mounted on a cylinder. In the latter case, the image setting process may be carried out in the printing machine or varnishing apparatus. A process of this type for producing an erasable gravure printing form is described in U.S. Pat. No. 6,070,528.

The gravure inking units 26 set against the form cylinders 1, 2 are used to ink the respective gravure printing form 25 in this case. Use may be made of chamber-type doctors. Bringing the form and transfer cylinders 1, 3 and 2, 4 into and out of mutual contact is effected by moving the slides 12 to 19 carrying them on the guide elements 10, 11, moving only one cylinder, for example the form cylinder 1, 2, also being sufficient. Changing one gravure printing form 25 for another gravure printing form 25 is carried out by exposing the form cylinder 1, 2 on one operating side so that the sleeve-like gravure printing form 25 arranged on the form cylinder may be pulled off and another form sleeve being pushed on. For this purpose of changing a printing form, a journal of the form cylinder 1, 2 is separated from the body of the form cylinder. The journal remains connected to the slide 12, 14 and is moved with the slide on the guide elements 10 out of the circumferential range of the form cylinder 1, 2. The separation of the journal from the form cylinder 1, 2 in this way is described in U.S. Pat. No. 6,186,065, the entire contents of which are incorporated herein by reference. After the printing form has been changed, the slide 12, 14 is moved into a position in which the journal is aligned with the form cylinder 1, 2. The journals may then be reconnected to the form cylinder 1, 2.

The varnishing mechanism 21 equipped for gravure printing may be changed over simply for offset printing. For this purpose, the sleeve-like gravure printing form 25 is pulled off of the form cylinder 1 as described above and a sleeve-like offset printing form 29 is pushed on. In addition, an offset inking unit 30 is set against the form cylinder 1 for inking the offset printing form 29. In the same way, the varnishing mechanism 22 may be fitted with an offset printing form 29 and an offset inking unit 30. The latter may use damping and inking rolls and associated damping and inking fountains. In addition, the sleeves 27 may be pulled off the transfer cylinders 3, 4 and replaced by new sleeves 31. Changing the sleeve on the transfer cylinder 3, 4 is performed in a manner similar to changing the form on the form cylinder 1, 2. Therefore, the transfer cylinder 3, 4 is exposed at an operating-side mounting, by its journal together with the slides 16, 18 being moved away out of the range of the transfer cylinder 3, 4. Using the varnishing mechanisms 21, 22 now changed over as printing mechanisms, for example, both sides of a web 28 may be printed on. If only one of the varnishing mechanisms 21, 22 is changed over into a printing mechanism, it is correspondingly possible to print on one side of a web 28 in the offset printing process. In the manner described, a printing mechanism equipped for offset printing may also be changed over to gravure printing. It is also possible for sleeves with a different external diameter to be fitted to the form cylinder 1, 2, by which means the form cylinder 1, 2 is changed in diameter, and therefore the printing format is changed. To set the different spacing of form and transfer cylinders 1, 3, 2, 4 required by the different size diameter, the form cylinders 1, 2 or transfer cylinders 3, 4 or all the cylinders 1 to 4 are moved on the guide elements 10, 11.

The gravure inking unit 26 and the offset inking unit 30 are fixed to the slides 12, 13 and 14, 15. Depending on the printing process selected, the gravure inking unit 26 or the offset inking unit 30 is hooked into the slides 12 to 15. Alternatively, both inking units 26, 30 may be inserted into the slides 12 to 15 at the same time. This arrangement of the inking units 26, 30 on the slides 12 to 15 allows the inking units 26, 30 to remain in a correct position when a change in the diameter of the form cylinder 1, 2 is required due to an associated spacing change in relation to the transfer cylinder 3, 4. Furthermore, the inking units 26, 30 are displacable in an approximately horizontal direction by moving devices 44, 45 to match the diameter of the form cylinders 1, 2 and to set them on and off of the form cylinders 1, 2. If the form cylinders 1, 2 are not arranged to be moveable, i.e., fixed, the inking units 26, 30 may be arranged in a predefined fixed position along the rectilinear guides 10, 11 and are displaced only by the moving devices 44, 45.

Figure 3:
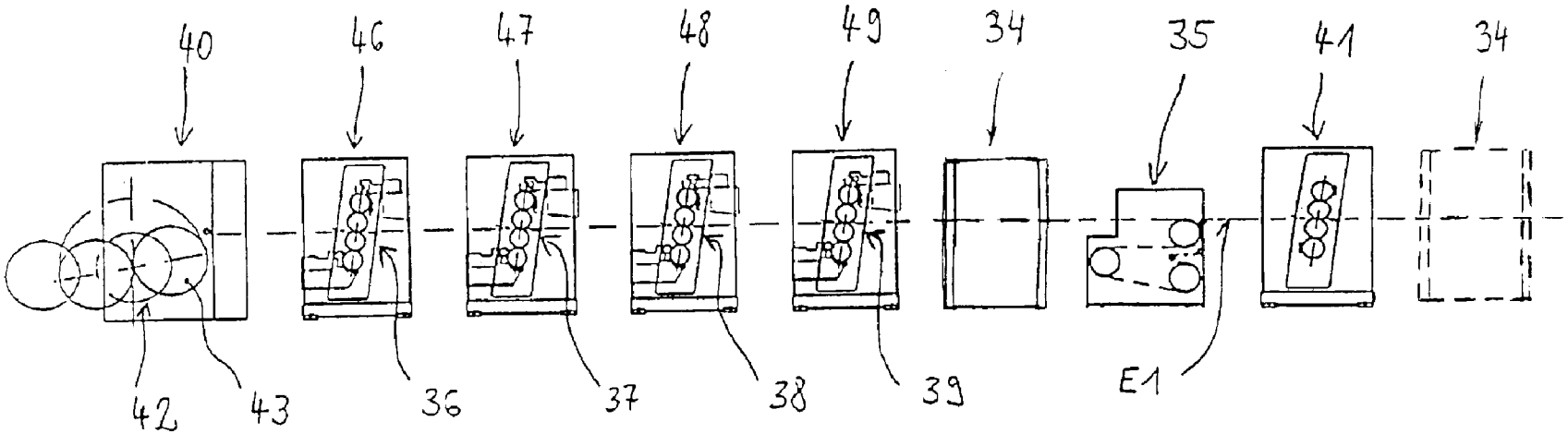
FIG. 3 is a sectional view of a printing machine having four printing units each having a double printing mechanism, a dryer following the printing units, a cooling device and a varnishing apparatus.

The rotary printing machine shown in FIG. 3 contains four printing units 46 to 49 each having a double printing mechanism 36 to 39. A winding device 40 is arranged upstream of the printing units 46 to 49 and a dryer 34, a cooling device 35 and a varnishing apparatus 41 are arranged downstream, the varnishing apparatus being the apparatus shown in FIG. 1.

A reel apparatus 42 operating in unwind operation and belonging to the winding device 40 unwinds a web 28 from a wound reel 43. The web is led in a plane E1 successively through the arranged double printing mechanisms 36 to 39 of the printing units 46 to 49. The web 28 is printed in four colours on both sides in the process and is dried in the dryer 34. The web 28 heated by the dryer 34 is subsequently cooled in the cooling device 35.

The varnishing apparatus 41 is arranged downstream of the dryer 34 and/or the cooling device. If further inks are to be applied to the web 28 downstream of the varnishing apparatus 41, then another dryer 34 should also be arranged downstream of the varnishing apparatus 41, as shown in the dashed lines in FIG. 3.

The printing machine configuration of FIG. 3 allows choosing between the gravure or offset printing processes in the varnishing apparatus 41. One printing process may be used for recto printing and the other printing process for verso printing. For example, the web 28 may be printed on both sides in recto printing being varnished over the entire area or partially in accordance with the gravure printing process and may printed on with a fifth ink or a special ink in verso printing in accordance with the offset printing process. However, a special ink may also be applied by the gravure printing process to the web 28 to be printed.

Downstream of the varnishing apparatus 41, the printed web 28 may either be wound up to form reels, fed to a plano-deliverer and delivered in sheet form, or processed in a folder to form folded products.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A combination including a varnishing apparatus for varnishing a web and a dryer being arranged upstream or downstream of the varnishing apparatus, said varnishing apparatus comprising:

first and second varnishing mechanisms, each including a form cylinder and a transfer cylinder, the web having two sides running between the transfer cylinders, at least one of the form cylinders includes a gravure printing form, said varnishing apparatus being arranged for varnishing one of the sides of the web when one of said form cylinders includes a gravure printing form and varnishing both of the sides of the web when each of the form cylinders includes a gravure printing form, wherein each of said form cylinder and transfer cylinder comprise two ends and said varnishing apparatus includes side walls for holding the ends of said form cylinders and transfer cylinders, each of said side walls defining an opening therethrough with two sides, rectilinear guide elements being arranged on at least one side of each of said openings, at least one of said form cylinder and transfer cylinder of each of said first and second varnishing mechanisms comprising slides slidably arranged on said rectilinear guide elements. such that a space between the form and transfer cylinders of each of said first and second varnishing mechanisms is adjustable.

2. The combination of claim 1, wherein only one of the form cylinders includes a gravure printing form and the other form cylinder includes an offset printing form, said varnishing apparatus further comprising a gravure inking unit settable against the form cylinder having the gravure printing form and an offset inking unit settable against the form cylinder having the offset printing form.

3. The combination of claim 1, wherein one of said transfer cylinders is an impression cylinder.

4. The combination of claim 1, wherein said form cylinder includes a replaceable sleeve-like printing form having an external diameter, said replaceable sleeve-like printing form being replaceable by replacement sleeve-like printing forms of the same or different external diameter.

5. The combination of claim 1, wherein said form cylinder of each of said first and second varnishing mechanisms has an external diameter and is replaceable by a replacement form cylinder of the same or different external diameter.

6. The combination of claim 1, further comprising a sleeve arranged on each of the transfer cylinders.

7. The combination of claim 1, wherein each of said first and second varnishing mechanisms further comprises an inking unit settable on said form cylinders, said inking units being movably arranged for moving along said rectilinear guide elements.

8. The combination of claim 1, wherein each of said first and second varnishing mechanisms further comprises an inking unit settable on said form cylinders, said inking units being arranged in a fixed position in said varnishing apparatus.

9. The combination of claim 7, wherein said first and second varnishing mechanisms each comprise a moving device for moving said inking units in a direction approximately normal to a length of said rectilinear guide.

10. The combination of claim 1, wherein at least one of the transfer cylinder and form cylinder of each of said first and second varnishing mechanisms is driven by an electric motor.

* * * * *